US008753157B2

(12) United States Patent
Yamazaki et al.

(10) Patent No.: US 8,753,157 B2
(45) Date of Patent: Jun. 17, 2014

(54) WATER JET PROPULSION BOAT

(75) Inventors: Susumu Yamazaki, Shizuoka (JP); Junya Miwa, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 342 days.

(21) Appl. No.: 13/253,094

(22) Filed: Oct. 5, 2011

(65) Prior Publication Data

US 2012/0190255 A1 Jul. 26, 2012

(30) Foreign Application Priority Data

Jan. 25, 2011 (JP) ..... 2011-012885

(51) Int. Cl.
*B63H 20/00* (2006.01)
*F02B 61/04* (2006.01)
*F02B 75/20* (2006.01)

(52) U.S. Cl.
USPC ..... 440/88 L

(58) Field of Classification Search
CPC ..... B63B 2770/00; F02B 61/045; F02B 2075/027; B63H 20/002; F01M 2001/126
USPC ..... 440/88 L
See application file for complete search history.

(56) References Cited

U.S. PATENT DOCUMENTS 6,705,270 B1 * 3/2004 Rau et al. ..... 123/195 C
7,958,861 B2 * 6/2011 Klumpp et al. ..... 123/196 R
2007/0272193 A1 11/2007 Muramatsu

FOREIGN PATENT DOCUMENTS

JP 2008-002455 A 1/2008

* cited by examiner

*Primary Examiner* — Daniel V Venne
(74) *Attorney, Agent, or Firm* — Keating & Bennett, LLP

(57) ABSTRACT

A water jet propulsion boat includes a main chamber rib dividing the inside of an oil pan into a main chamber where an oil suction port of an oil suction tube is arranged, and an auxiliary chamber outside of the main chamber. The main chamber rib covers the oil suction port at least from the front side and from the left and right sides of the oil suction port. The main chamber rib projects upward from the floor of the oil pan. An opening through which oil passes is provided in the main chamber rib only rearward of a rear edge of the oil suction port. The main chamber and the auxiliary chamber communicate with each other through the opening.

11 Claims, 8 Drawing Sheets

WATER JET PROPULSION BOAT

BACKGROUND OF THE INVENTION

1. Field of the Invention

The present invention relates to a water jet propulsion boat.

2. Description of the Related Art

A water jet propulsion boat is affected by a backward gravitational acceleration when accelerated, by a forward gravitational acceleration when decelerated, and by a gravitational acceleration opposite to a direction of a turn to the left or right. As a result, oil in an oil pan tends to tilt in various directions. The oil pan, which is arranged on the bottom of the engine compartment, is also shallow and thin because the drive shaft in a water jet propulsion boat must be arranged low in the watercraft body. Therefore, only a limited volume of oil can be stored in the pan, and when the oil tilts, the oil suction port of the oil pump is exposed from the surface of the oil and the oil pump tends to suck in air.

Therefore, in the lubricating apparatus disclosed by Japanese Laid-open Patent Application No. 2008-002455, the oil chamber is divided into a main oil chamber and an auxiliary oil chamber, and a feed pump supplies oil from the main oil chamber to lubricated sections of the engine. A scavenging pump returns the oil in the auxiliary oil chamber to the main oil chamber. As a result, tilting of oil in the main oil chamber is lessened.

SUMMARY OF THE INVENTION

The lubricating apparatus disclosed by Japanese Laid-open Patent Application No. 2008-002455, however, requires two types of oil pumps. This requirement increases the number of parts and leads to an increased cost. Preferred embodiments of the present invention provide a water jet propulsion boat that can prevent suctioning of air by an oil pump while avoiding an increase in the number of parts.

The water jet propulsion boat according to one preferred embodiment of the present invention includes a watercraft body, an engine accommodated in the watercraft body, and a jet pump section driven by the engine. The engine includes a crankshaft, a crankcase, an oil pan, an oil suction tube, an oil pump, and a main chamber rib. The crankcase supports a crankshaft. The oil pan is arranged below the crankcase. The oil suction tube includes an oil suction port arranged inside the oil pan. The oil pump is connected to the oil suction tube, and draws in oil from the suction port. The main chamber rib divides the interior of the oil pan into a main chamber where the oil suction port is arranged and an auxiliary chamber outside of the main chamber. The main chamber rib borders the oil suction port at least from a front side and from left and right sides of the oil suction port. The main chamber rib projects upward from a floor of the oil pan. An opening through which oil passes is provided in the main chamber rib at a location only rearward of a rear edge of the suction port of the oil suction tube. The main chamber and the auxiliary chamber communicate with each other through the opening.

In the water jet propulsion boat according to a preferred embodiment of the present invention, oil is supplied by the oil pump from the oil pan to sections of the engine, then returned to the oil pan. The water jet propulsion boat assumes a posture with the bow raised when operated normally; that is, propelled forward. Therefore, oil collects in the back of the oil pan. When this occurs, because an opening is provided in a portion of the main chamber rib rearward of the rear edge of the oil suction port, oil passes through the opening and into the main chamber. When a gravitational force bears forward when decelerating or a gravitational force bears to the left or right when turning, most of the oil can collect in the main chamber because no opening is provided in the portion of the main chamber rib in front of the rear edge of the oil suction port. Thus, the water jet propulsion boat according to various preferred embodiments of the present invention can prevent suctioning of air by an oil pump without increasing the number of parts by designing the location of an opening communicating between the main chamber and the auxiliary chamber inside the oil pan.

The above and other elements, features, steps, characteristics and advantages of the present invention will become more apparent from the following detailed description of the preferred embodiments with reference to the attached drawings.

BRIEF DESCRIPTION OF THE DRAWINGS

DETAILED DESCRIPTION OF THE PREFERRED EMBODIMENTS (1) Overall Configuration of the Water Jet Propulsion Boat A water jet propulsion boat 1 according to a preferred embodiment of the present invention will be described hereinafter with reference to the accompanying drawings. FIG. 1 is a side elevation view of the overall configuration of the water jet propulsion boat 1. The water jet propulsion boat 1 is a so-called personal watercraft (PWC). As shown in FIG. 1, the water jet propulsion boat 1 includes a watercraft body 2, an engine 3, and a jet pump section 4. The watercraft body 2 includes a deck 5 and a hull 6. A seat 7 is arranged on the deck 5. A steering handle 8, which is used to steer the watercraft body 2, is arranged in front of the seat 7. In the following description, directions such as front, back, left, right, and diagonal will be taken to refer to the direction when viewed by a rider seated on the seat 7 while the water jet propulsion boat 1 is floating on still water.

Figure 1:
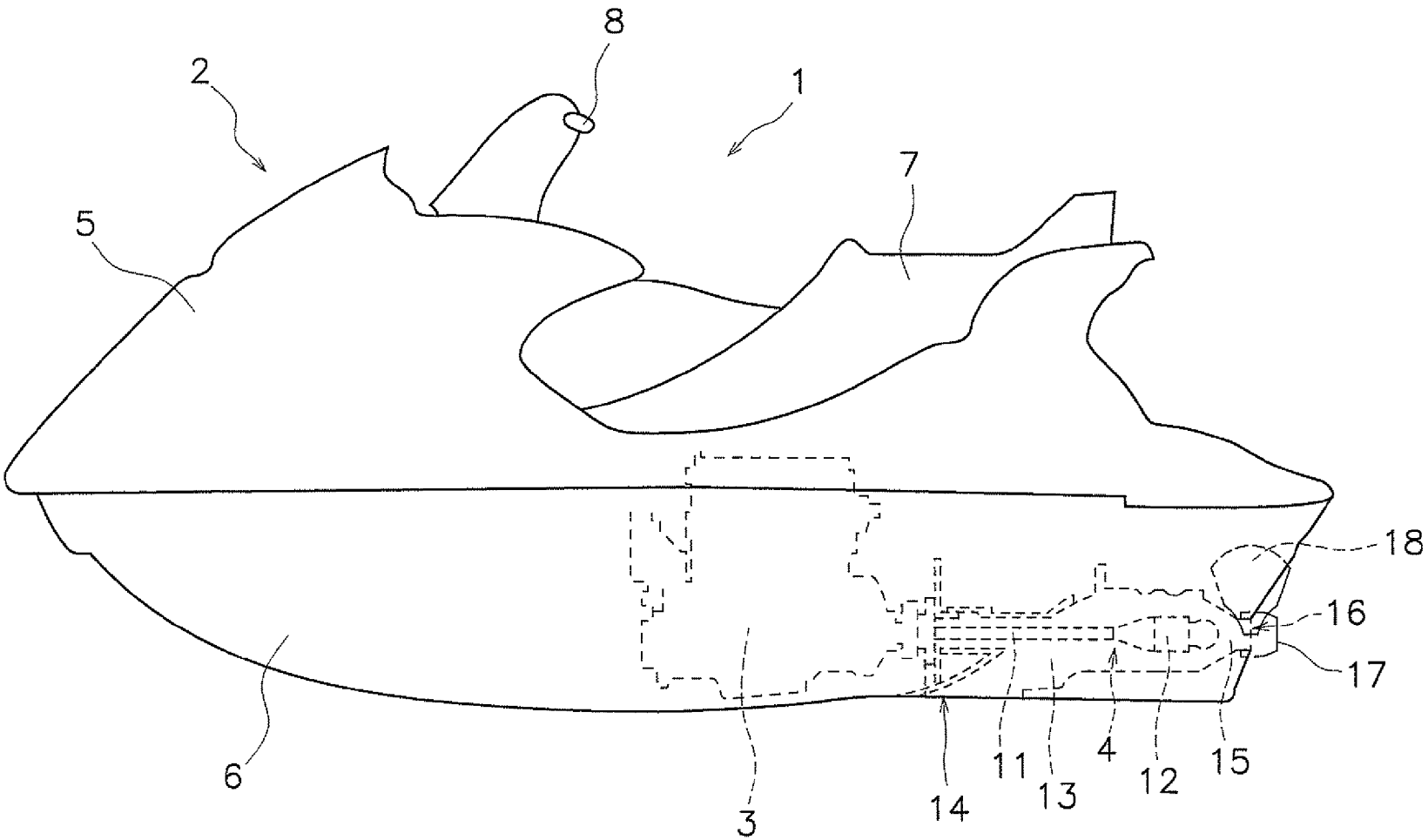
FIG. 1 is a side elevation view of a water jet propulsion boat according to a preferred embodiment of the present invention.

The engine 3 is housed inside the watercraft body 2. The detailed configuration of the engine 3 will be described below. The jet pump section 4 is arranged behind the engine 3. The jet pump section 4 includes a drive shaft 11 and an impeller 12. The drive shaft 11 extends in the longitudinal direction of the water jet propulsion boat 1. The front portion of the drive shaft 11 is attached to a crankshaft 27 of the engine 3 to be described below. The impeller 12 is attached to the rear portion of the drive shaft 11. The output from the engine 3 is transmitted by the drive shaft 11 to the impeller 12. Thus, the impeller is driven 12 to rotate. The impeller 12 is arranged in a water passage 13 provided in a lower portion of the watercraft body 2. The water passage 13 communicates with a water inlet 14. The water inlet 14 is provided on the bottom of the boat in a location forward of the impeller 12. A water discharge section 15 is disposed in a rear portion of the watercraft body 2. The water discharge section 15 is disposed behind the impeller 12.

The water discharge section 15 includes a water outlet 16. The water outlet 16 communicates with the water passage 13. By rotating the impeller 12, water is drawn from the water inlet 14 and sprayed from the water discharge section 15. This generates a propulsive force that propels the watercraft body 2.

A deflector 17 is attached to the water discharge section 15. The deflector 17 is disposed so as to be capable of turning left and right in association with the operation of the steering handle 8. Turning the deflector 17 to the left and right varies the spray direction of water to the left and right. A reverse bucket 18 is attached to the water discharge section 15. The reverse bucket 18 is disposed so as to be capable of turning up and down. The reverse bucket 18 is in an upward position when the water jet propulsion boat 1 is moving forward. This causes water to be sprayed rearward from the water outlet 16. The reverse bucket 18 is arranged in a location behind the water outlet 16 when the water jet propulsion boat 1 is moving in reverse. As a result, the direction of water spray is changed to forward.

(2) Configuration of the Engine 3

Figure 2:
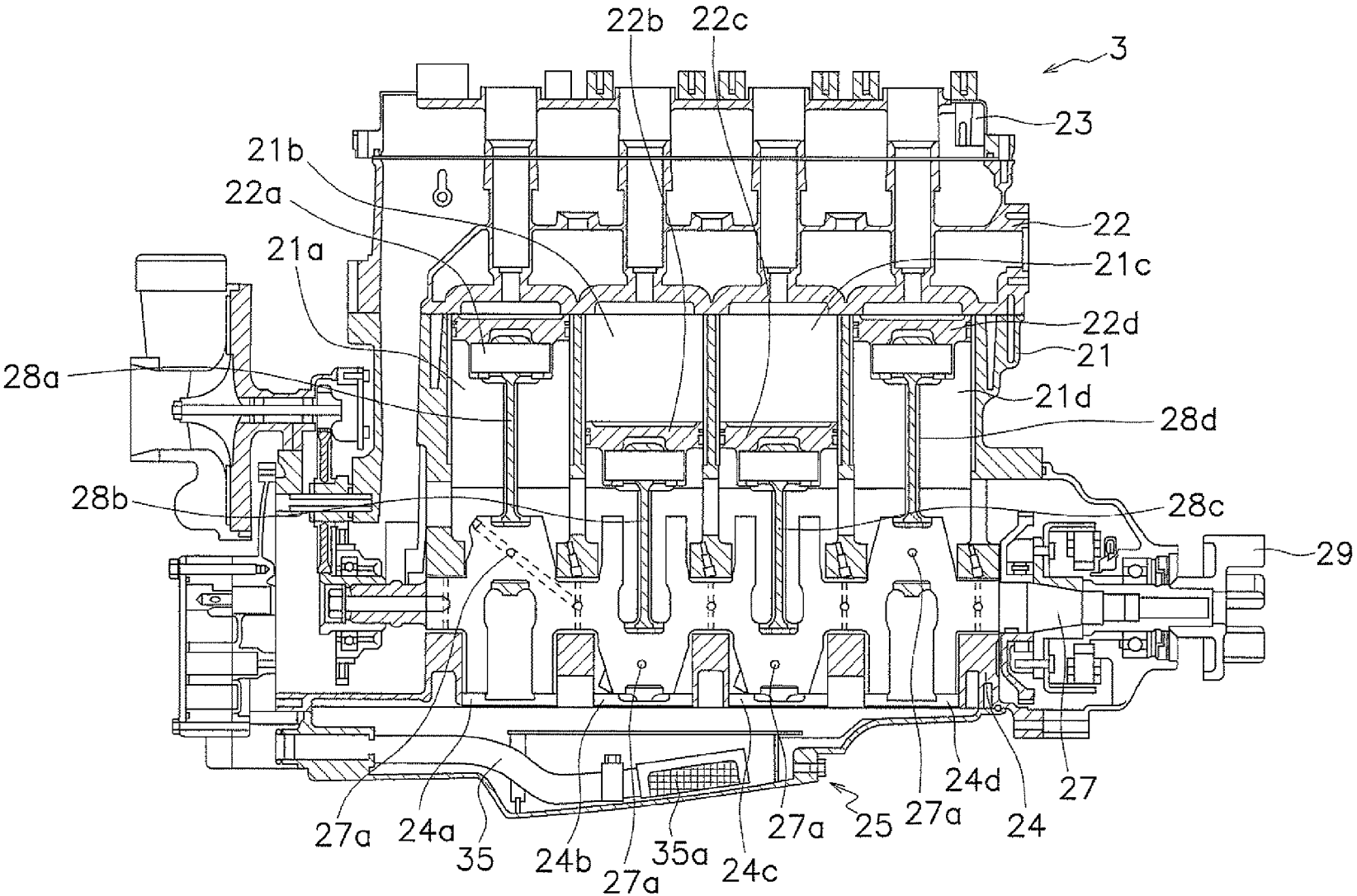
FIG. 2 is a side elevation section view of an engine.

Next, the configuration of the engine 3 will be described in detail. FIG. 2 is a side elevation section view of the engine 3. The engine 3 is preferably a water-cooled four-cycle in-line four-cylinder engine. The engine 3 includes a cylinder block 21, a cylinder head 22, a head cover 23, a crankcase 24, an oil pan unit 25, and an oil pump 26 (see FIG. 5). The cylinder block 21 includes four cylinders 21*a* to 21*d*. The cylinders 21*a* to 21*d* are arranged in a line along the longitudinal direction. The axes of the cylinders 21*a* to 21*d* extend vertically. Pistons 22*a* to 22*d* are arranged inside the cylinders 21*a* to 21*d*.

The cylinder head 22 is connected to the top surface of the cylinder block 21. An intake port and an exhaust port (not shown) are provided in the cylinder head 22. The head cover 23 is connected to the top surface of the cylinder head 22. The crankcase 24 is connected to the bottom surface of the cylinder block 21. A crankshaft 27 is arranged inside the crankcase 24. The crankshaft 27 is rotatably supported by the crank case 24. The axis of rotation of the crankshaft 27 extends in the longitudinal direction. The crankshaft 27 is linked to the pistons 22*a* to 22*d* by connecting rods 28*a* to 28*d*. The drive shaft 11 described above is connected to the back end of the crankshaft 27 by a coupling member 29. Openings 24*a* to 24*d*, through which oil passes, are provided in the bottom surface of the crankcase 24.

The oil pan unit 25 is arranged below the crankcase 24. The oil pan unit 25 is linked to the bottom surface of the crankcase 24. The oil pan unit 25 is detachably attached to the crankcase 24 by attaching devices, such as bolts, for example. The top of the oil pan unit 25 is open, and the space inside the oil pan unit 25 communicates with the space inside the crankcase 24 through the openings 24*a* to 24*d*. The oil pump 26 supplies a lubricating oil to sections of the engine 3 (see FIG. 5). The oil pump 26 is connected to an oil suction tube 35 to be described below, and draws oil from an oil suction port 35*a*. The oil pump 26 supplies oil to the crankshaft 27 via an oil hole 27*a* provided in the crankshaft 27. The oil supplied to the crankshaft 27 drops from inside the crankcase 24 into the oil pan unit 25. Next, the configuration inside the oil pan unit 25 will be described in detail.

Figure 3:
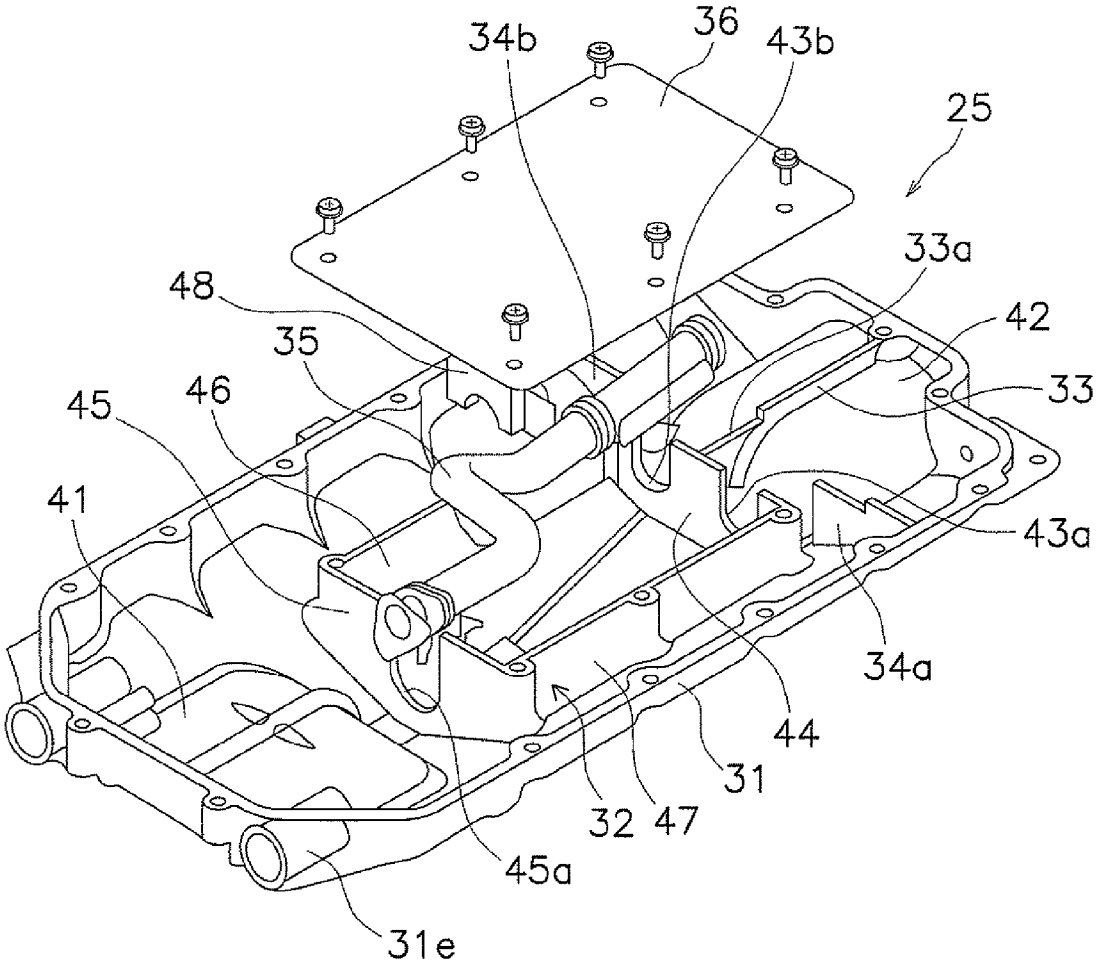
FIG. 3 is a partially exploded perspective view of an oil pan unit.
Figure 4:
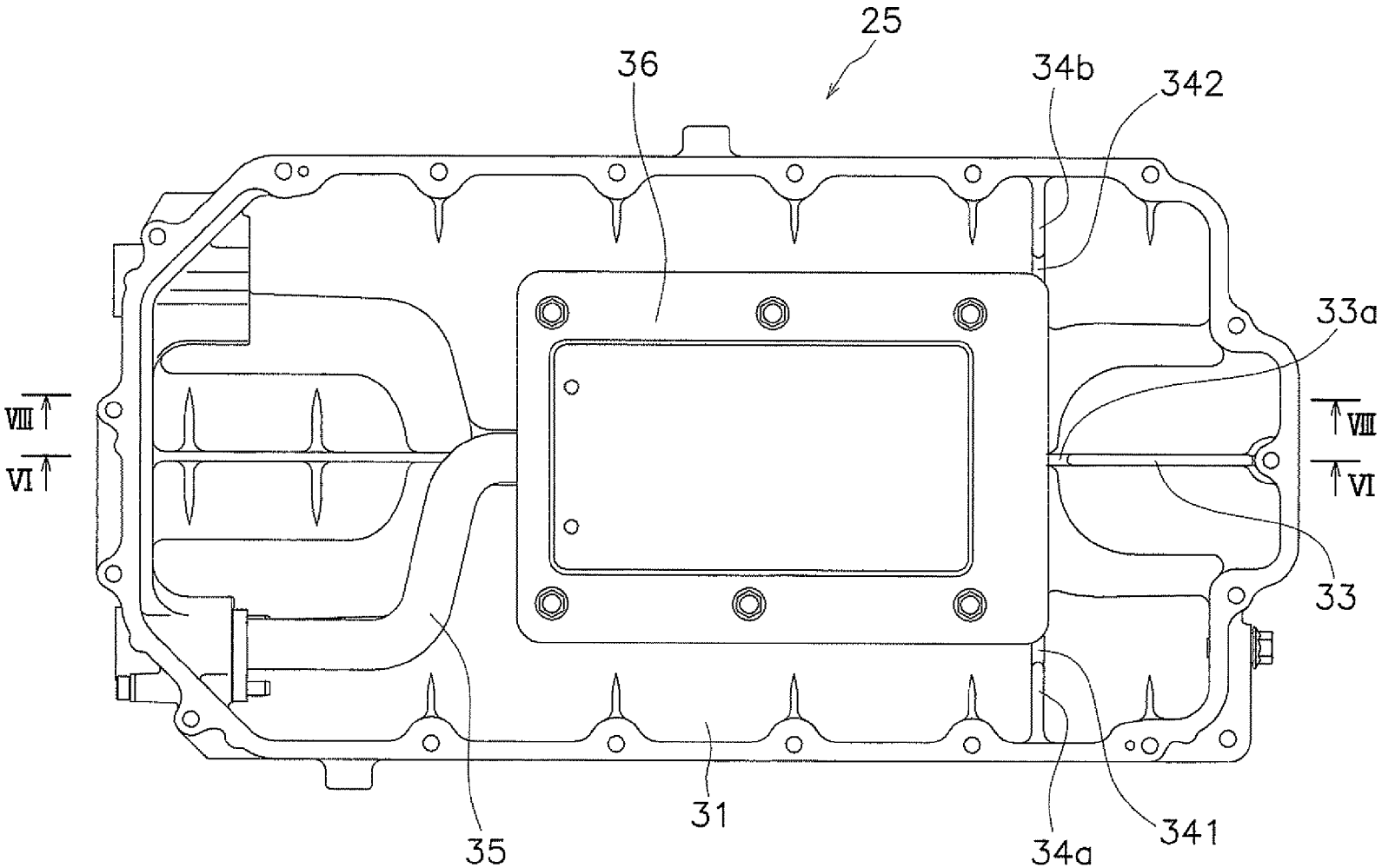
FIG. 4 is a top plan view of an oil pan unit.

FIG. 3 is an exploded perspective view of the oil pan unit 25. FIG. 4 is a top plan view of the oil pan unit 25. As shown in FIGS. 3 and 4, the oil pan unit 25 includes an oil pan 31, a main chamber rib 32, a longitudinal rib 33, left and right transverse ribs 34*a* and 34*b*, an oil suction tube 35, and a lid member 36.

Figure 5:
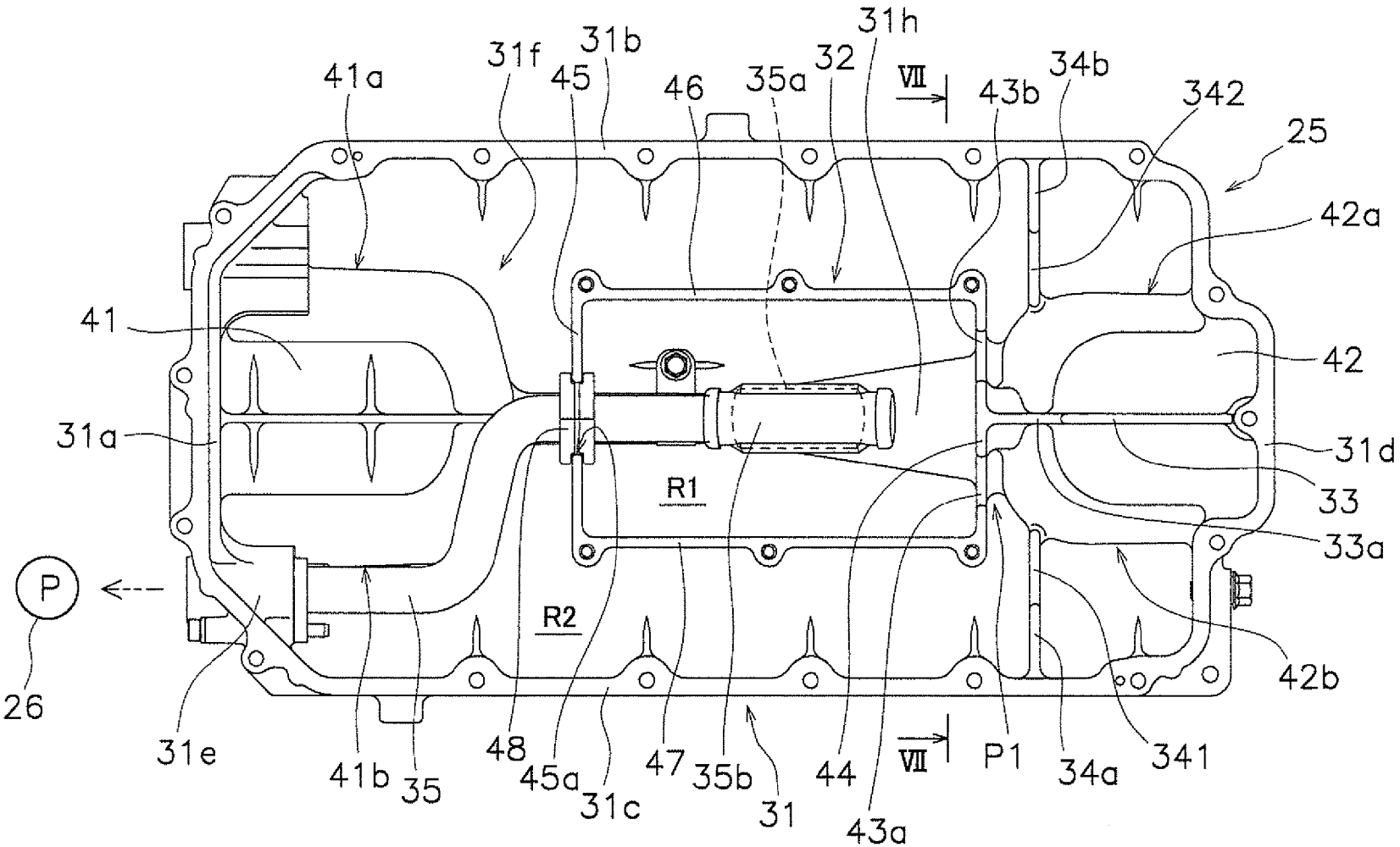
FIG. 5 is a top plan view of an oil pan unit with a lid member removed.

The oil pan 31 is arranged below the crankcase 24. The vertical dimension of the oil pan 31 is preferably less than the dimension in the longitudinal direction and the dimension in the transverse direction, and the oil pan 31 has a shallow and thin shape. FIG. 5 is a top plan view of the oil pan unit 25 with the lid member 36 removed. As shown in FIG. 5, a front projection 41 and a back projection 42, both projecting upward, are provided on the floor 31*f* of the oil pan 31. The front projection 41 is arranged in front of the floor 31*f* of the oil pan 31, and is connected to the front wall 31*a* of the oil pan 31. The right edge 41*a* of the front projection 41 is spaced a distance from the right wall 31*b* of the oil pan 31. The left edge 41*b* of the front projection 41 is spaced a distance from the left wall 31*c* of the oil pan 31. The back projection 42 is arranged in back of the floor 31*f* of the oil pan 31, and is connected to the back wall 31*d* of the oil pan 31. The right edge 42*a* of the back projection 42 is spaced a distance from the right wall 31*b* of the oil pan 31. The left edge 42*b* of the back projection 42 is spaced a distance from the left wall 31*c* of the oil pan 31. A connection 31*e* is disposed in the front wall 31*a* of the oil pan 31. The oil suction tube 35 is attached to the connection 31*e*.

Figure 6:
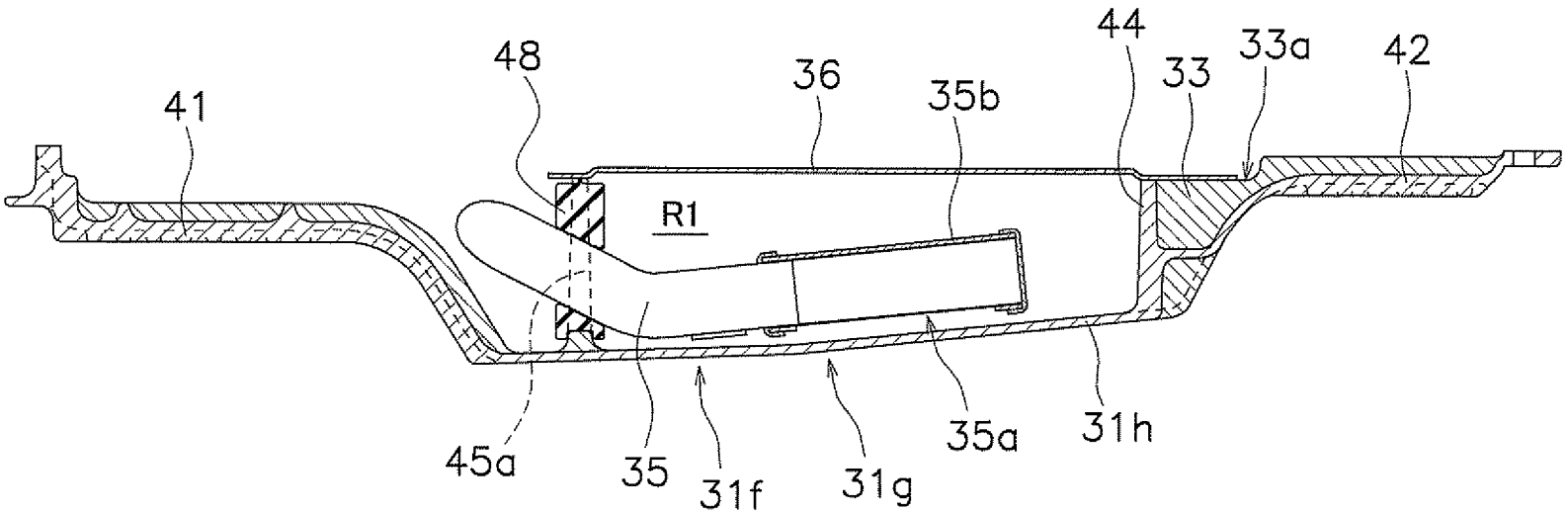
FIG. 6 is a section view across line VI-VI in FIG. 4.
Figure 7:
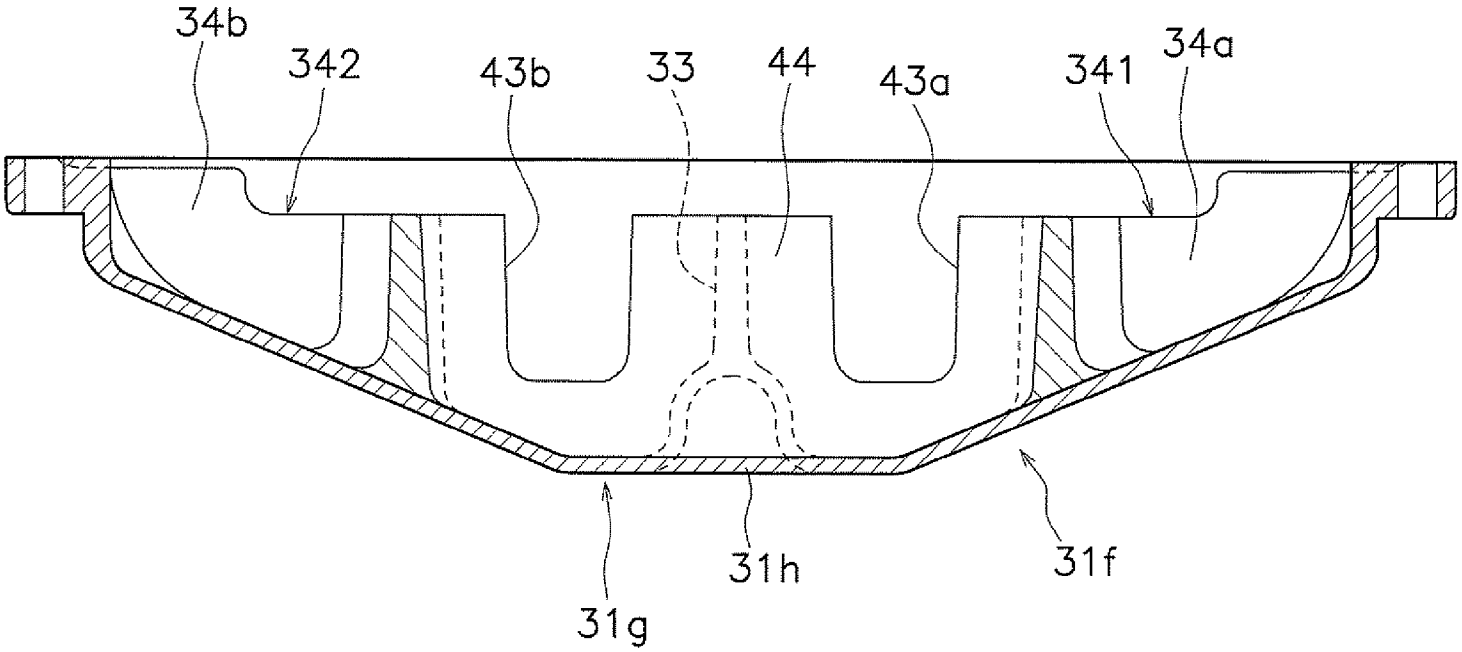
FIG. 7 is a section view across line VII-VII in 5.

As shown in FIG. 5, the main chamber rib 32 divides the inside of the oil pan 31 into a main chamber R1 and an auxiliary chamber R2 outside the main chamber R1. The main chamber rib 32 is arranged between the front projection 41 and the back projection 42 in the longitudinal direction. FIG. 6 is a section view across line VI-VI in FIG. 4. As shown in FIG. 6, the oil suction port 35*a* of the oil suction tube 35 is arranged in the main chamber R1. The main chamber rib 32 borders the oil suction port 35*a* from its front side and from its left and right sides of the oil suction port 35*a*, and projects upward from the floor of the oil pan 31. The portion of the floor 31*f* of the oil pan 31 between the front projection 41 and the back projection 42 is tilted upward as it extends rearward. Therefore, the floor 31*g* of the main chamber R1 tilts upward as it extends rearward. As shown in FIG. 5, a flat section 31*h* is provided in a central portion in the transverse direction of the floor 31*g* of the main chamber R1. The flat section 31*h* has a tapered shape when viewed from above, in which the dimension in the transverse direction increases as the flat section 31*h* extends toward the back. FIG. 7 is a section view across line VII-VII in FIG. 5. The flat section 31*h* is preferably disposed parallel or substantially parallel to horizontal. A central portion in the transverse direction of the floor 31*f* of the oil pan 31 is lower than the left and right edges of the floor 31*f* of the oil pan 31.

As shown in FIG. 5, two holes 43*a* and 43*b* (hereafter called "left opening 43*a*" and "right opening 43*b*"), define first and second openings which communicate between the main chamber R1 and the auxiliary chamber R2 and through which oil passes, are provided in the main chamber rib 32 only at a location rearward of the rear edge of the oil suction port 35*a* of the oil suction tube 35. The left opening 43*a* and the right opening 43*b* are arranged in a line along the transverse direction. The left and right edges of the left opening 43*a* and the right opening 43*b* are located transversely inward of the left and right edges of the main chamber rib 32, respectively. Specifically, the left edge of the left opening 43*a* is located transversely inward of the left edge of the main chamber rib 32. The right edge of the right opening 43*b* is located transversely inward of the right edge of the main chamber rib 32. In this preferred embodiment, "transversely inward" refers to the direction closer to the center of the oil pan 31 in the transverse direction.

Figure 8:
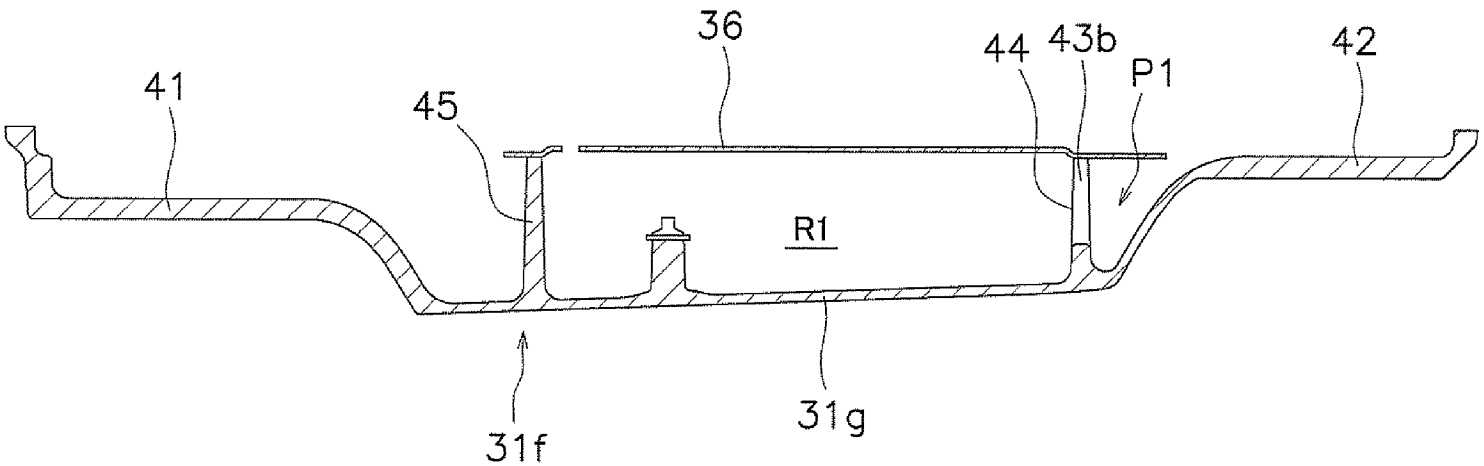
FIG. 8 is a section view across line VIII-VIII in 4.

Specifically, the main chamber rib 32 preferably has a nearly rectangular shape when viewed from above, and includes a rear surface portion 44, a front surface portion 45, a right surface portion 46, and a left surface portion 47. The rear surface portion 44 preferably has a thin plate shape extending in the transverse direction. The rear surface portion 44 borders the oil suction port 35*a* from the rear side of the oil suction port 35*a*. The left opening 43*a* and the right opening 43*b* are provided in the rear surface portion 44. The left opening 43*a* and the right opening 43*b* are spaced a distance in the transverse direction. A central portion in the transverse direction of the floor 31*f* of the oil pan 31 is arranged between the left opening 43*a* and the right opening 43*b*. FIG. 8 is a section view across line VIII-VIII in FIG. 4. As shown in FIGS. 7 and 8, the bottom edge of the left opening 43*a* and the bottom edge of the right opening 43*b* are located higher than the floor 31g of the main chamber R1. The top edges of the left opening 43*a* and the right opening 43*b* reach the top edge of the rear surface portion 44.

As shown in FIG. 5, the front surface portion 45 preferably has a thin plate shape extending in the transverse direction. The front surface portion 45 borders the oil suction port 35*a* from the front side of the oil suction port 35*a*. As shown in FIG. 3, a notch 45*a* is provided in the front surface portion 45. The oil suction tube 35 passes through the notch 45*a*. The oil suction tube 35 is attached to the notch 45*a* by an attaching member 48 made of an elastic material, such as rubber, for example. As shown in FIGS. 5 and 6, the attaching member 48 seals the gap between the edges of the oil suction tube 35 and the notch 45*a*.

The right surface portion 46 and the left surface portion 47 are preferably arranged symmetrically in the transverse direction. The right surface portion 46 preferably has a thin plate shape extending in the longitudinal direction. The right surface portion 46 borders the oil suction port 35*a* from the right side of the oil suction port 35*a*. The right surface portion 46 is arranged nearly in a line in the longitudinal direction with the right edge 41*a* of the front projection 41 and the right edge 42*a* of the back projection 42. The left surface portion 47 preferably has a thin plate shape extending in the longitudinal direction. The left surface portion 47 borders the oil suction port 35*a* from the left side of the oil suction port 35*a*. The left surface portion 47 is arranged nearly in a line with the left edge 41*b* of the front projection 41 and the left edge 42*b* of the back projection 42.

The rear surface portion 44 is located in front of the back projection 42 at a distance from the back projection 42. The front surface portion 45 is located behind the front projection 41 at a distance from the front projection 41. The right surface portion 46 is arranged at a distance from the right wall 31*b* of the oil pan 31 in the transverse direction. The left surface portion 47 is arranged at a distance from the left wall 31*c* of the oil pan 31 in the transverse direction. Therefore, the main chamber rib 32 is arranged at an interval from the inner walls of the oil pan 31 both in the transverse and longitudinal directions. The distance between the front surface portion 45 and the front projection 41 is preferably greater than the distance between the rear surface portion 44 and the back projection 42. The distance between the right surface portion 46 and the right wall 31*b* is preferably greater than the distance between the rear surface portion 44 and the back projection 42. The distance between the left surface portion 47 and the left wall 31*c* is preferably greater than the distance between the rear surface portion 44 and the back projection 42. The distance between the front surface portion 45 and the front wall 31*a* of the oil pan 31 is preferably greater than the distance between the rear surface portion 44 and the back wall 31*d* of the oil pan 31.

The longitudinal rib 33 projects upward from the floor of the oil pan 31, and extends to the back of the oil pan 31 from the main chamber rib 32. The longitudinal rib 33 is preferably arranged between the left opening 43*a* and the right opening 43*b* in the transverse direction. The longitudinal rib 33 is disposed above the back projection 42 and extends to the rear surface portion 44 of the main chamber rib 32. Therefore, the longitudinal rib 33 divides routes P1 between the rear surface portion 44 of the main chamber R1 and the back projection 42 into a left side and a right side. The longitudinal rib 33 also divides the space inside the oil pan 31 located behind the rear surface portion 44 of the main chamber R1 into a left side and a right side. As shown in FIGS. 3 and 6, a first step 33*a* is provided in a front portion of the top edge of the longitudinal rib 33. The first step 33*a* is located lower than the back portion of the top edge of the longitudinal rib 33, and at the same height as the top edge of the rear surface portion 44 of the main chamber R1.

As shown in FIG. 5, the left and right transverse ribs 34*a* and 34*b* project upward from the floor of the oil pan 31, and are arranged rearward of the main chamber rib 32. The left and right transverse ribs 34*a* and 34*b* are also arranged rearward of the front edge of the back projection 42. Therefore, the left and right transverse ribs 34*a* and 34*b* are located rearward of the routes P1 between the rear surface portion 44 and the back projection 42. The left transverse rib 34*a* extends transversely inward from the left wall 31*c* of the oil pan 31. The left transverse rib 34*a* extends from the left wall 31*c* of the oil pan 31 to the left edge 42*b* of the back projection 42. The right edge of the left transverse rib 34*a* is located between the left edge of the rear surface portion 44 and the left edge of the left opening 43*a* in the transverse direction. As shown in FIGS. 5 and 7, a second step 341 is provided in a right portion of the top edge of the left transverse rib 34*a*. The second step 341 is located lower than the left portion of the top edge of the left transverse rib 34*a*, and at the same height as the top edge of the rear surface portion 44 of the main chamber R1. The right transverse rib 34*b* extends transversely inward from the right wall 31*b* of the oil pan 31. The right transverse rib 34*b* extends from the right wall of the oil pan 31 to the right edge 42*a* of the back projection 42. The left edge of the right transverse rib 34*b* is located between the right edge of the rear surface portion 44 and the right edge of the right opening 43*b*. As shown in FIGS. 5 and 7, a third step 342 is provided in a left portion of the top edge of the right transverse rib 34*b*. The third step 342 is located lower than the right portion of the top edge of the right transverse rib 34*b*, and at the same height as the top edge of the rear surface portion 44 of the main chamber R1.

The oil suction tube 35 is arranged inside the oil pan 31. A back portion of the oil suction tube 35 preferably has a linear shape extending in the longitudinal direction. An oil strainer 35*b* is disposed in the back portion of the oil suction tube 35. The oil suction port 35*a* described above is preferably provided on the bottom of the oil strainer 35*b*. The oil strainer 35*b* is arranged inside the main chamber R1. The oil suction port 35*a* is preferably arranged rearward of the center of the main chamber R1 in the longitudinal direction. The oil suction port 35*a* is arranged above the center of the floor 31*f* of the oil pan 31 in the transverse direction. More specifically, the oil suction port 35*a* is arranged above the flat section 31*h* described above. An intermediate portion of the oil suction tube 35 preferably has a curved shape. A front portion of the oil suction tube 35 preferably has a linear shape extending in the longitudinal direction. The front portion of the oil suction tube 35 is arranged to the side of the front projection 41. Specifically, the front portion of the oil suction tube 35 is arranged between the left edge 41*b* of the front projection 41 and the left wall 31*c* of the oil pan 31, for example. The front portion of the oil suction tube 35 is connected to the connection 31*e* described above. The oil pump 26 is connected to the connection 31*e* by tubing (not shown). The oil pump 26 draws oil from the main chamber R1 by the oil suction tube 35, and supplies the oil to the sections inside the engine 3 described above.

The lid member 36 shown in FIGS. 3 and 4 is detachably attached to the top edge of the main chamber R1 by attaching devices, such as bolts, for example. The lid member 36 covers the main chamber R1 from above the main chamber R1. The lid member 36 has a larger outer shape than the outer shape of the main chamber R1. Specifically, as shown in FIG. 6, the rear edge of the lid member 36 is located rearward of the rear surface portion 44 of the main chamber R1. The lid member 36 extends rearward as far as a location above the space between the main chamber rib 32 and the left and right transverse ribs 34*a* and 34*b*. Therefore, the lid member 36 covers the area above the space between the main chamber rib 32 and the left and right transverse ribs 34*a* and 34*b*. Specifically, as shown in FIG. 8, the lid member 36 covers the area above the route P1 between the rear surface portion 44 of the main chamber R1 and the back projection 42. As shown in FIG. 4, a back portion of the lid member 36 is located above the first step 33*a* of the longitudinal rib 33, the second step 341 of the left transverse rib 34*a*, and the third step 342 of the right transverse rib 34*b* described above.

(3) Features of the Water Jet Propulsion Boat 1 According to the Present Preferred Embodiment In the water jet propulsion boat according to the preferred embodiment, oil is supplied by the oil pump 26 from the oil pan 31 to the sections of the engine 3, then returned to the oil pan 31. The water jet propulsion boat 1 assumes a posture with the bow raised when operated normally; that is, propelled forward. Therefore, oil is dispersed throughout the oil pan 31 but collects toward the back of the oil pan 31 because the boat assumes a posture with the bow raised when propelled forward. Because left and right openings 43*a* and 43*b* are provided in the rear surface portion 44 of the main chamber rib 32, the oil flows through the left and right openings 43*a* and 43*b* and into the main chamber R1. When a gravitational force bears forward during a deceleration of the water jet propulsion boat 1 or when a gravitational force bears to the left or right during a turn of the water jet propulsion boat 1, the oil inside the main chamber R1 less readily flows out of the main chamber R1 because no opening is provided in the portion of the main chamber rib 32 in front of the rear edge of the oil suction port 35*a*. In particular, the openings 43*a* and 43*b* are disposed only in the rear surface portion 44, and no opening is disposed in the front surface portion 45 or the left and right surface portions 46 and 47. Therefore, even if the oil inside the main chamber R1 tilts forward or to the left or right when decelerating or turning the water jet propulsion boat 1, most of the oil still collects inside the main chamber R1. The water jet propulsion boat 1 may continue to turn for a long time, and this often causes a state in which the oil continues to tilt in one direction inside the oil pan 31. Even in this circumstance, most of the oil still collects inside the main chamber R1, which can prevent the oil pump 26 from suctioning air. Thus, the water jet propulsion boat 1 according to the present preferred embodiment can prevent the oil pump 26 from suctioning air without increasing the number of parts, which is achieved by not requiring the installation of another pump to draw oil from the auxiliary chamber R2.

The left and right edges of the left and right openings 43*a* and 43*b* are located transversely inward of the left and right edges of the main chamber rib 32. Therefore, the oil inside the main chamber R1 is impeded from flowing from the left and right openings 43*a* and 43*b* into the auxiliary chamber R2 even when the water jet propulsion boat 1 is decelerated or turned. As a result, even more of the oil can collect in the main chamber R1.

The longitudinal rib 33 can prevent oil from flowing to the left or right in the routes P1 behind the rear surface portion 44. Therefore, oil tends to flow from the right of the longitudinal rib 33 to the right opening 43*b*, and oil tends to flow from the left of the longitudinal rib 33 to the left opening 43*a*. This has the effect of guiding most of the oil inside the main chamber R1. A central portion in the transverse direction of the floor 31*f* of the oil pan 31 is lower than the edges. Therefore, the central portion is also lower than the side portions to the left and right in the routes P1 behind the rear surface portion 44. Therefore, the oil tends to flow to the left and right openings 43*a* and 43*b*, which has the effect of guiding most of the oil inside the main chamber R1.

The left and right transverse ribs 34*a* and 34*b* can prevent oil from flowing from back to front inside the auxiliary chamber R2. The left and right transverse ribs 34*a* and 34*b* can also guide the flow of oil from rearward of the main chamber R1 toward the left and right openings 43*a* and 43*b*. This has the effect of guiding most of the oil inside the main chamber R1.

Having the lid member 36 project rearward of the rear surface portion 44 can prevent oil from overflowing from behind the main chamber R1 to above the lid member and flowing forward. This has the effect of guiding most of the oil inside the main chamber R1.

The oil suction port 35*a* is arranged rearward of the center of the main chamber R1 in the longitudinal direction. This configuration can further prevent suctioning air from the oil suction port 35*a* when the water jet propulsion boat 1 assumes a posture with the bow raised.

The floor 31*g* of the main chamber R1 tilts rearward and upward. This configuration lessens the angle of inclination of the floor 31*g* of the main chamber R1 to horizontal when the water jet propulsion boat 1 assumes a posture with the bow raised. As a result, less oil tilts to the back of the oil pan 31 when the water jet propulsion boat 1 assumes a posture with the bow raised, which can further prevent suctioning air from the oil suction port 35*a*.

A central portion in the transverse direction of the floor 31*f* of the oil pan 31 is lower than the left and right edges of the floor 31*f* of the oil pan 31. The oil suction port 35*a* is also arranged above the central portion in the transverse direction of the floor 31*f* of the oil pan 31. This configuration can further prevent suctioning air from the oil suction port 35*a* when turning the water jet propulsion boat 1.

The main chamber rib 32 is arranged at an interval from the inner walls of the oil pan 31 both in the transverse and longitudinal directions. Therefore, the oil around the main chamber R1 inside the oil pan 31 tends to flow to the back of the main chamber R1 when the water jet propulsion boat 1 assumes a posture with the bow raised. The oil flowing to the back of the main chamber 1 also flows through the left and right openings 43*a* and 43*b* and into the main chamber R1. This has the effect of guiding most of the oil inside the main chamber R1.

The bottom edges of the left and right openings 43*a* and 43*b* are arranged higher than the floor 31*g* of the main chamber R1. Therefore, oil inside the main chamber R1 can be prevented from flowing out to the auxiliary chamber R2. As a result, more of the oil can collect inside the main chamber R1.

(4) Other Preferred Embodiments

A preferred embodiment of the present invention have been described above, but the present invention is not limited to this preferred embodiment, and various variations and modifications may be possible without departing from the scope of the present invention.

The present invention is not limited to a personal watercraft (PWC), and may be applied to other types of water jet propulsion boats, such as a sports boat (jet boat).

The type of the engine 3 is not limited to a water-cooled four-cycle in-line four-cylinder type. For example, the engine 3 may be a two-cycle engine. The number of cylinders of the engine 3 is not limited to four as described above.

The shape of the main chamber rib 32 is not limited to a rectangular shape in a top view as described above. The opening is not limited to the rear surface portion 44, and may be provided in a back portion of the left and right surface portions 46 and 47. The number of openings is not limited to two; just one or three or more openings may be provided in the main chamber rib 32.

The present invention can provide a water jet propulsion boat that can prevent suctioning of air by an oil pump while avoiding an increase in the number of parts.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A water jet propulsion boat comprising:

a watercraft body;

an engine accommodated in the watercraft body; and a jet pump section driven by the engine; wherein the engine includes:

a crankshaft;

a crankcase arranged to support the crankshaft;

an oil pan arranged below the crankcase;

an oil suction tube including an oil suction port arranged inside the oil pan;

an oil pump arranged to draw oil from the oil suction port, the oil pump being connected to the oil suction tube;

a main chamber rib arranged to divide an interior of the oil pan into a main chamber where the oil suction port is located and an auxiliary chamber outside of the main chamber, the main chamber rib bordering the oil suction port from at least a front side and left and right sides of the oil suction port, and projecting upward from a floor of the oil pan; and a first opening through which oil passes provided in the main chamber rib at a location only rearward from a rear edge of the suction port of the oil suction tube; wherein the main chamber and the auxiliary chamber communicate with each other through the first opening.

2. The water jet propulsion boat according to claim 1, wherein left and right edges of the first opening are located transversely inward of left and right edges of the main chamber rib.

3. The water jet propulsion boat according to claim 1, wherein the main chamber rib includes a rear surface portion to border the oil suction port from a rear side of the oil suction port, and the first opening is provided in the rear surface portion.

4. The water jet propulsion boat according to claim 3, wherein a second opening is further provided in the rear surface portion so as to be in a line in a transverse direction of the water jet propulsion boat relative to the first opening, and the water jet propulsion boat further comprises a longitudinal rib arranged between the first and second openings and extending rearward from the main chamber rib.

5. The water jet propulsion boat according to claim 1, further comprising left and right transverse ribs arranged rearward of the main chamber rib and extending transversely inward from left and right inner walls of the oil pan.

6. The water jet propulsion boat according to claim 5, further comprising a lid member covering an area above the main chamber and extending rearward to a location above a space between the main chamber rib and the left and right transverse ribs.

7. The water jet propulsion boat according to claim 1, wherein the suction port is arranged rearward of a center of the main chamber in a longitudinal direction of the water jet propulsion boat.

8. The water jet propulsion boat according to claim 1, wherein the floor of the main chamber is tilted upward as it extends rearward.

9. The water jet propulsion boat according to claim 1, wherein a central portion of the floor of the oil pan in a transverse direction of the water jet propulsion boat is lower than edges of the floor of the oil pan in the transverse direction, and the suction port is arranged above the central portion of the floor of the oil pan in the transverse direction.

10. The water jet propulsion boat according to claim 1, wherein the main chamber rib is spaced from inner walls of the oil pan in both a transverse direction and a longitudinal direction of the water jet propulsion boat.

11. The water jet propulsion boat according to claim 1, wherein a bottom edge of the first opening is located higher than the floor of the main chamber.

* * * * *